US007070351B2

(12) United States Patent
Cooper et al.

(10) Patent No.: US 7,070,351 B2
(45) Date of Patent: Jul. 4, 2006

(54) WRITING INSTRUMENT WITH GRIPPING DEVICE

(75) Inventors: Kenneth R Cooper, Orange, CT (US); Donald A DeLuca, Guilford, CT (US); Michael Kent, Cheshire, CT (US); Richard O'Brien, Oxford, CT (US)

(73) Assignee: BIC Corporation, Milford, CT (US)

( * ) Notice: Subject to any disclaimer, the term of this patent is extended or adjusted under 35 U.S.C. 154(b) by 44 days.

(21) Appl. No.: 10/391,179

(22) Filed: Mar. 14, 2003

(65) Prior Publication Data

US 2003/0198500 A1 Oct. 23, 2003

Related U.S. Application Data

(60) Continuation-in-part of application No. 29/168,681, filed on Oct. 8, 2002, now Pat. No. Des. 480,107, and a continuation-in-part of application No. 29/168,675, filed on Oct. 8, 2002, now Pat. No. Des. 478,933, which is a division of application No. 29/153,606, filed on Jan. 14, 2002, now Pat. No. Des. 468,354, which is a continuation-in-part of application No. 29/145,136, filed on Jul. 17, 2001, now Pat. No. Des. 456,041.

(51) Int. Cl.
*A46B 5/02* (2006.01)

(52) U.S. Cl. ..... 401/6; 16/430

(58) Field of Classification Search ..... 401/6, 401/17, 21; 16/430; D19/47–51
See application file for complete search history.

(56) References Cited

U.S. PATENT DOCUMENTS 141,287 A * 7/1873 Orndorff ..... 15/443
D19,278 S * 8/1889 Todd, Jr. ..... D19/58
768,935 A 8/1904 Goldsmith
798,749 A * 9/1905 Rose ..... 401/88
1,334,860 A * 3/1920 Hughes ..... 401/89
1,762,554 A * 6/1930 Hume ..... 401/249
D107,438 S 12/1937 MacNally ..... D19/36
2,236,194 A 3/1941 Lorber
D156,633 S 12/1949 Krause ..... D19/47
D159,978 S 9/1950 Green et al.
D161,310 S 12/1950 Brown ..... D19/47
2,643,409 A 6/1953 Hemdel et al.
D187,253 S 2/1960 Lambert ..... D19/47
D234,225 S 1/1975 Ito
4,030,841 A * 6/1977 Balasty ..... 401/6
4,976,564 A 12/1990 Fukuoka et al.
D324,634 S 3/1992 Chen
D327,912 S 7/1992 Tsai
D341,622 S 11/1993 Poisson ..... D19/48
5,354,140 A * 10/1994 Diakoulas ..... 401/6
D357,699 S 4/1995 Takanashi
D358,170 S 5/1995 Osada (Continued)

*Primary Examiner*—David J. Walczak
(74) *Attorney, Agent, or Firm*—Jones Day

(57) ABSTRACT

A gripping element, particularly to writing instruments having a gripping element, which more specifically relates to a marker having a gripping element over a central region thereof. Such positioning of the gripping element facilitates use of the writing instrument in other than standard writing grasps. For example, the positioning of a gripping element over the central region of a writing instrument facilitates gripping of the writing instrument when writing on vertical or inverse horizontal (i.e. upside down) planes. The gripping element has a plurality of elevated sections in the form of intercalated crosses and hexagons or sliced hexagons. The elevated sections may be smooth or textured to enhance gripping and to reduce slippage of the writing instrument during use.

12 Claims, 4 Drawing Sheets

U.S. PATENT DOCUMENTS

| | | | | |
|---|---|---|---|---|
| D359,758 | S | 6/1995 | Inami | |
| D378,761 | S | 4/1997 | Sekine | |
| D404,426 | S | 1/1999 | Takanashi | |
| D404,763 | S | 1/1999 | Shimizu | D19/47 |
| D425,124 | S | 5/2000 | Chen | D19/57 |
| 6,062,753 | A | 5/2000 | Hadtke et al. | 401/6 |
| D428,441 | S | 7/2000 | Isobe et al. | |
| 6,206,595 | B1 | 3/2001 | Keda | |
| D441,398 | S | 5/2001 | Owen et al. | |
| D442,992 | S | 5/2001 | Chevalier | |
| 6,296,409 | B1 | 10/2001 | Cherry et al. | 401/6 |
| D456,041 | S | 4/2002 | Cooper et al. | D19/43 |
| D461,500 | S | 8/2002 | Cooper et al. | D19/43 |
| D468,354 | S | 1/2003 | Cooper et al. | D19/55 |

* cited by examiner

WRITING INSTRUMENT WITH GRIPPING DEVICE

This application is a continuation-in-part of U.S. Design application Ser. No. 29/168,675, now U.S. Design Pat. No. D478,933 and U.S. Design application Ser. No. 29/168,681, now U.S. Design Pat. No. D480,107, both of which were filed Oct. 8, 2002; which are divisional applications of U.S. Design application Ser. No. 29/153,606, which was filed Jan. 14, 2002, now U.S. Design Pat. No. D468,354; which is a continuation-in-part of U.S. Design application Ser. No. 29/145,136 which was filed Jul. 17, 2001, now U.S. Design Pat. No. D456,041.

FIELD OF THE INVENTION

The present invention relates generally to writing instruments having a gripping element. More specifically, the present invention relates to a marker or other type of writing instrument used with wand-like movements, having a gripping element thereon.

BACKGROUND OF THE INVENTION

Most writing instruments include an elongated tubular body (i.e., the writing instrument body) containing a writing medium, such as ink or pencil lead, or a highlighting medium, such as yellow, green, and pink highlighter ink or the like, and have a writing end at which the writing medium is exposed for contact with the writing surface, such as paper. Because users often grasp at least fine writing instruments tightly, gripping devices have been provided to assist a user in manually gripping a writing instrument, such as to impart comfort and increased control and thus improved legibility in writing. Moreover, such gripping devices are typically positioned to be held close to the writing end of a writing instrument to allow relatively fine control for writing, for example, words or symbols. The writing instruments are generally characterized by a smooth exterior surface typically formed of plastic or other hard material. The exterior surface may be attractive and pleasant to the touch; however, it can be become slippery or dirty during use, resulting in writer discomfort and impaired use and reduced legibility.

Writing instruments for fine writing, such as pencils, ball point pens, roller ball pens, and porous point type pens, are typically grasped and held by the user in close proximity to the writing end for fine control. In contrast, markers, which typically comprise a felt or felt-like nib at the writing end (in contrast to the writing point of fine-writing instruments) typically are grasped centrally and moved with wand-like movements. Such movements may be associated with the nature of the writing instrument itself. For instance, when writing in such a quick or non-precise manner, a marker is typically held in a central region (i.e., approximately equidistant from each end of the marker) and used in the above-described wand-like fashion. The felt or felt-like nib increases the flow of writing medium to allow quick or non-precise writing. The nib further allows a writing medium to flow to the nib when writing on vertical or non-horizontal surfaces. Thus, markers may conveniently be held in a horizontal or inverse vertical (i.e., upside down) plane, as is typically the case, for example, when used by plumbers, movers, teachers, lecturers, etc. Once again, grasping the marker in a central region is more convenient than closer to the writing end in such orientation.

Markers generally are not provided with gripping devices to enhance gripping of the marker. Moreover, gripping devices that have been provided on markers have only been positioned close to the writing end of the marker, like gripping devices of fine-writing instruments, to allow relatively fine control for writing, for example, words or symbols or other indicia.

Accordingly, there is a need for a gripping device configured for use on a marker to impart and to enhance comfort during all typical uses of the marker. In addition, there is a need for a gripping device for a marker formed from a material that is comfortable and easy to grip, yet also particularly well suited for the environment in which the marker is used.

SUMMARY OF THE INVENTION

The present invention relates generally to a grip element that is adapted to be used with an article, such as a writing instrument (particularly a marker), to enhance use of the article such as by promoting increased comfort, grip, and cleanliness of the grip member.

The present invention encompasses a gripping element formed and/or fabricated to fit over an article, and, particularly, over a gripping section of the article, if present. The outer surface may be comprised of a tough (e.g., a non-wear), dirt-repellent material (e.g., an elastomer). Alternatively or additionally, a plurality of elevated sections may be provided on the outer surface of the gripping element. The plurality of elevated sections are preferably positioned on the outer surface in a pattern enhancing various characteristics (e.g., comfort during writing, or maintaining a rounded article in a rest position when laid on a surface during non-use). The elevated sections may be non-contiguous, intercalated but spaced apart shapes, such as intercalated crosses and hexagons or sliced hexagons. The surface of the gripping section between the raised shapes may have a rough, non-smooth, unsmooth, or textured surface to inhibit build-up of dirt or grime in the sunken gaps between the raised shapes.

The present invention also encompasses a writing instrument having a gripping element comprising an elongated writing instrument body having a first end (e.g., a distal end), a second end (e.g., a proximal end), and a central region between the first end and the second end. A gripping section is arranged along a midpoint of the writing instrument (substantially equidistant from the first end and the second end) for gripping the writing instrument in a wand-like fashion for use in quick or non-precise writing or for writing on vertical or inverse-horizontal surfaces. A gripping element is positioned over the gripping section and extends at least over the midpoint of the writing instrument and between the midpoint and the second end of the writing instrument and is spaced apart from the first end and the second end.

The invention further encompasses a method of using a writing instrument with a gripping element over a central region or gripping section between the first and second ends of the writing instrument. In particular, the gripping member may be located along a midpoint equidistant from the first end and the second end of the writing instrument but spaced apart from the first end and the second end (and thus clearly is not to be confused with a grip cover such as an elastomeric coating covering the entire barrel of the writing instrument). The method includes gripping the writing instrument over the grip member and writing in a wand-like manner on a vertical, substantially vertical, or inverse-horizontal plane.

The grip is formed from a material different from the material of the writing instrument body and may be separately formed from or co-molded with the writing instrument body. The material of the gripping element may be softer and/or more resilient than the material of the writing instrument body to enhance gripping.

DETAILED DESCRIPTION OF THE INVENTION

The present invention relates generally to a gripping element for use on an article. The gripping element may be applied to any article and may be formed, configured, and positioned to be well suited for use on a writing instrument, such as a marker, used in a wand-like fashion and gripped in a central region.

Figure 2:
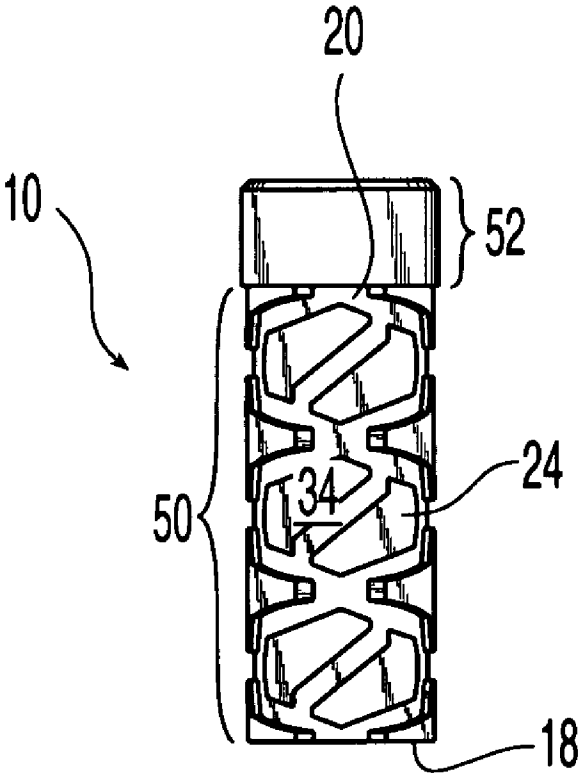
FIG. 2 is an elevational view of a gripping element as in FIG. 1, that may be used in accordance with the principles of the present invention, and showing a second shape of an exemplary elevated pattern on the gripping element.
Figure 1:
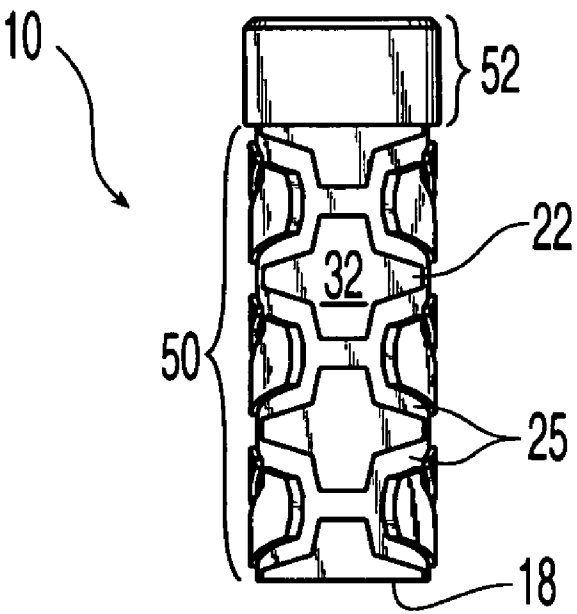
FIG. 1 is an elevational view of a gripping element that may be used in accordance with the principles of the present invention, and showing a first shape of an exemplary elevated pattern on the gripping element.
Figure 4:
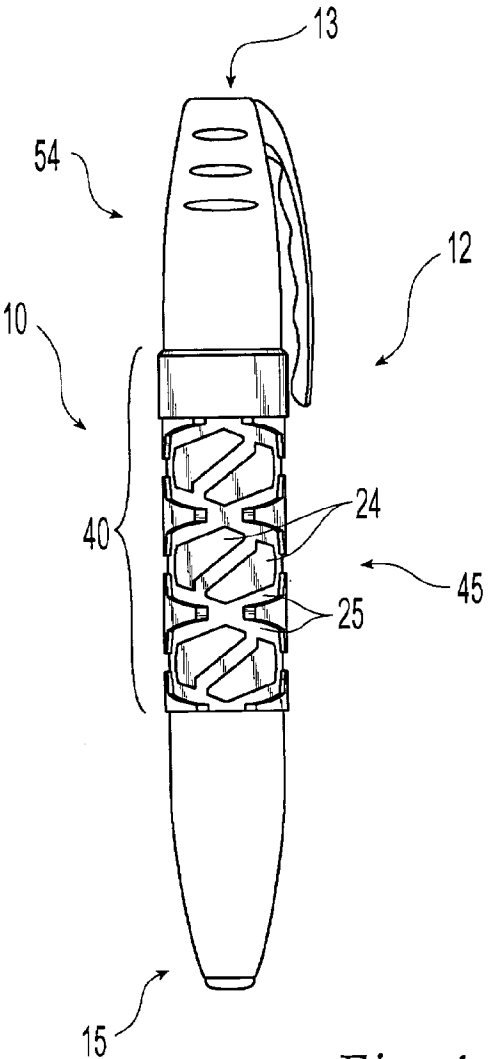
FIG. 4 is a side elevational view of a writing instrument with an exemplary gripping element as in FIG. 1 positioned substantially at the midpoint of the writing instrument in accordance with one aspect of the present invention.
Figure 3:
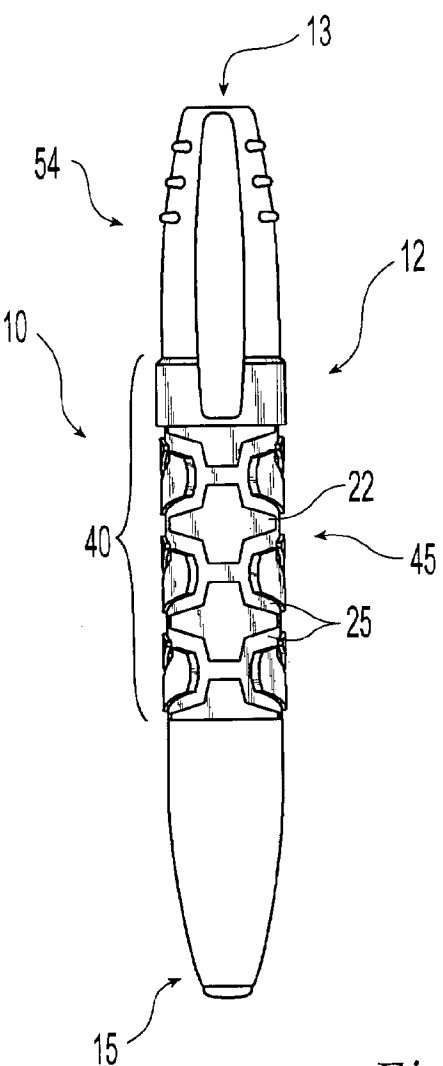
FIG. 3 is a front elevational view of a writing instrument with an exemplary gripping element as in FIG. 1 positioned substantially at the midpoint of the writing instrument in accordance with one aspect of the present invention.

Referring to FIGS. 1 and 2, an exemplary embodiment of a gripping element 10 formed in accordance with the principles of the invention is illustrated. According to one aspect of the present invention, gripping element 10 may be provided on a writing instrument 12 at a position equidistant from first end 13 and second end 15 of writing instrument 12, as shown in FIGS. 3 and 4 as discussed in detail below. Such position is specifically selected to enhance use of the writing instrument in a wand-like manner, as also discussed in detail below. However, various novel aspects of a gripping element, in accordance with the principles of the present invention, may be applied to any type of gripping element for any type of article, as will now be described.

Gripping element 10 may be configured for mounting on an article specifically configured to receive gripping element 10. For example, gripping element 10 may be inserted over a gripping section of an article (i.e., a section specifically configured for gripping). The gripping section may be specifically designed or configured to receive gripping element 10 such that gripping element 10 is specifically designed or configured for insertion over such article. For instance, gripping element 10 may fit within a recess in an article, such that the article has a uniform outer diameter even with the grip mounted thereon. However, gripping element 10 need not be specifically designed or configured for a particular article and may be mounted over an article not specifically configured or designed to receive a gripping element. If gripping element 10 is inserted over an article not specially designed for receiving any type of element thereover, gripping element 10 typically will have an outer diameter larger than the outer surface of the portion of the article not covered by gripping element 10. Gripping element 10 may have a total outer diameter of at least about 1.0 inch (2.5 cm), such as for a grip for mounting on a writing instrument. The total outer diameter of gripping element 10 is typically less than about 3.0 inches (7.6 cm) so that gripping element 10 may still be grasped in the hand of a user. However, it will be appreciated that the dimensions and configuration of the gripping element 10 of the invention may vary as desired.

It will be appreciated that the same gripping element may be fitted over either type of article. If desired, gripping element 10 may be formed to be removable from the article and placeable on alternate articles as desired. In addition or alternatively, an article may be prefabricated with gripping element 10. As may be appreciated from the Figures, gripping element 10 has discrete ends from the ends of the writing instrument itself spaced and is not to be mistaken for a uniform covering over the entire length of the article.

Gripping element 10 may be mounted on an article in any desired manner. For instance, gripping element 10 may be axially inserted over an end portion of a hand-held article and advanced until positioned over a central region of the article. Alternatively, gripping element 10 may be inserted over an article in a direction transverse to the longitudinal axis of the article, such that gripping element 10 is positioned at the desired location upon mounting, without having to be advanced axially.

Gripping element 10 may be formed with a mounting structure, such as a receiving channel 18, by which gripping element 10 may be optionally mounted on an article. It is noted that reference herein is made to a "receiving channel" for the sake of convenience, and not with any intent to limit the mounting structure to only a "receiving channel." Receiving channel 18 is configured to receive a portion of an article such as a writing instrument, securely therein. Receiving channel 18 preferably is dimensioned and configured to correspond to the outer dimension of the portion of the article on which grip element 10 is to be mounted so that this portion is securely maintained therein. For example, the receiving channel 18 is typically more than about 0.2 inch (0.5 cm) to fit over a finger-manipulated article and typically is less than about 2.0 inches (5.0 cm) to fit even a typical hand-held article. In the present invention, a finger-held or finger-manipulated article (referenced herein as only "finger-held" for the sake of simplicity and not for limiting purposes) is an article configured for grasping and/or manipulation by a user's fingers during its ordinary use and typically receives pressure or force applied by a user's fingers or fingertips. Exemplary finger-held or finger-manipulated articles include, but are not limited to, writing implements, shavers, razors, toothbrushes, eating utensils, precision instruments, scissors, and the like. According to the present invention, finger-held articles are to be distinguished from "hand-held" articles which are intended to be held by a user's hand (in contrast to only by the fingers) under a normal use circumstance. Examples of hand-held articles can include, but are not limited to, sports rackets, sports equipment handles (e.g., bicycle or motorcycle handles), steering wheels, tools (e.g., hammers), cooking utensils, and the like. However, mounting structure 15 may be configured in any other manner to secure the article therein. For example, an interior of receiving channel 18 may include flexible protrusions, which resiliently conform to the exterior of the portion of the article to be received within receiving channel 18. If desired, the article and receiving channel 18 may be matingly contoured, such as by the provision of grooves on one and ribs on the other which mate or engage with one another.

Gripping element 10 will typically have an outer surface 20, which is a non-smooth, unsmooth, or rough ("textured" hereafter for the sake of convenience and without intent to limit, other than to surfaces that are not smooth) surface that repels dirt and grime. In addition, gripping element 10 preferably is fabricated from a material that imparts a non-slip or non-skid surface to a user, and that does not easily attract dirt and grime. Gripping element 10 may be fabricated from an elastomeric material such as, but not limited to, a thermoplastic elastomer. The material of gripping element 10 preferably has a Shore A hardness of at least about 50 durometers so that dust, grime, or other particles will not remain adhered to the surface of the grip. Lower hardnesses may be appropriate as well, so long as such hardness does not interfere with molding or manufacturing thereof. The Shore A hardness preferably is at most about 70 durometers to provide a comfortable, grip. Higher hardnesses may be may be appropriate as well, though a moderately compressible, elastomeric feel (in contrast with a mere rigid plastic feel) is desirable. A Shore A durometer of 60 has been found to be suitable.

Figure 6:
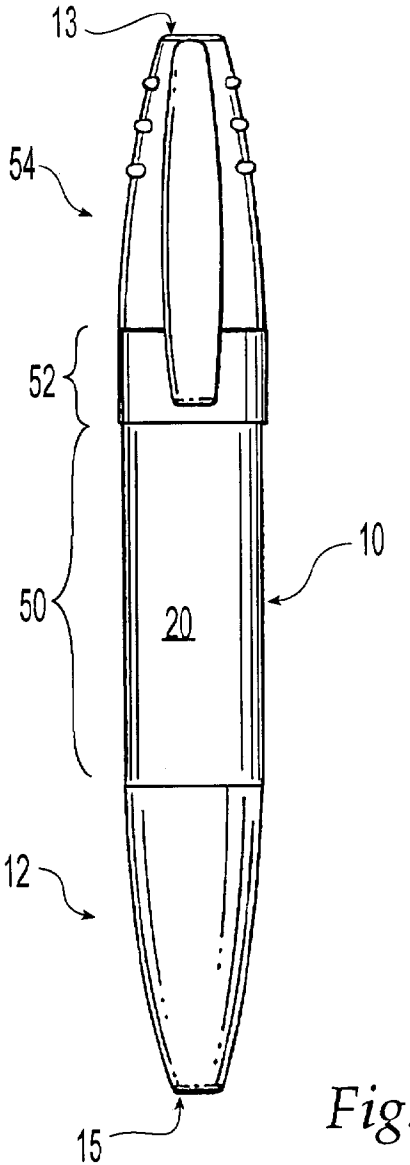
FIG. 6 is a front elevational view of a tank-type writing instrument with a smooth grip positioned substantially at the midpoint of the writing instrument in accordance with one aspect of the present invention.

Gripping element 10 may have a relatively uniform diameter with a smooth or textured surface. Moreover, the surface of gripping element 10 maybe dimpled, ribbed, or otherwise provided with a grip-enhancing pattern. For instance, as illustrated in FIG. 6, gripping element 10 has a relatively smooth outer surface. A plurality of elevated sections (e.g., 22 and 24) may be raised above the outer surface to vary the grip texture and thus to enhance gripping further. For example, elevated sections 22 and 24 may impart a non-slip or non-skid grip to a user (e.g., to prevent slippage such as from sweating in an industrial environment), allow better control of an article (e.g., for writing quickly in an industrial setting on, for example, pipes or boxes), and/or allow more degrees of freedom (e.g., marking overhead). Elevated sections 22 and 24, which are raised above the outer surface, may be configured to be intercalated or meshed together. For example, sections 22, 24 may be in the form of crosses 22 or hexagons or sliced hexagons 24. Elevated sections 22 and 24 may extend at least about 0.1 mm (to be perceptible) and typically are not more than 3.0 mm above outer surface 20 of grip 10. An elevation of about 0.5 mm has been found to be acceptable. While gripping comfort is enhanced by elevated sections 22 and 24, slippage is inhibited by gaps 25 between elevated sections 22 and 24. Elevated sections 22 and 24 preferably are not so elevated above outer surface 20 of gripping element 10 that gaps 25 therebetween create discomfort.

According to one embodiment of the invention, the outer surfaces 32 and 34 of elevated sections 22 and 24 may be formed to be relatively comfortable to grip and may be smooth or textured, as desired. Outer surface 20 of gripping element 10 (from which elevated sections 22 and 24 rise) may be textured to inhibit build-up of dirt and/or grime, as described above. The spacing of elevated sections 22 and 24 may be selected to be far apart and thus the width of gaps 25 may be wide enough so that small particles cannot become lodged in gaps 25 and any particle large enough to become lodged in gaps 25 is readily dislodged. Such dimensions are readily determined by those of ordinary skill in the art, and may be approximately 1–2 mm for standard usage and environments. As will be appreciated, the formation of outer surface 20 as textured, rather than smooth, further facilitates enhanced cleanliness and longer wear of gripping element 10.

Figure 5:
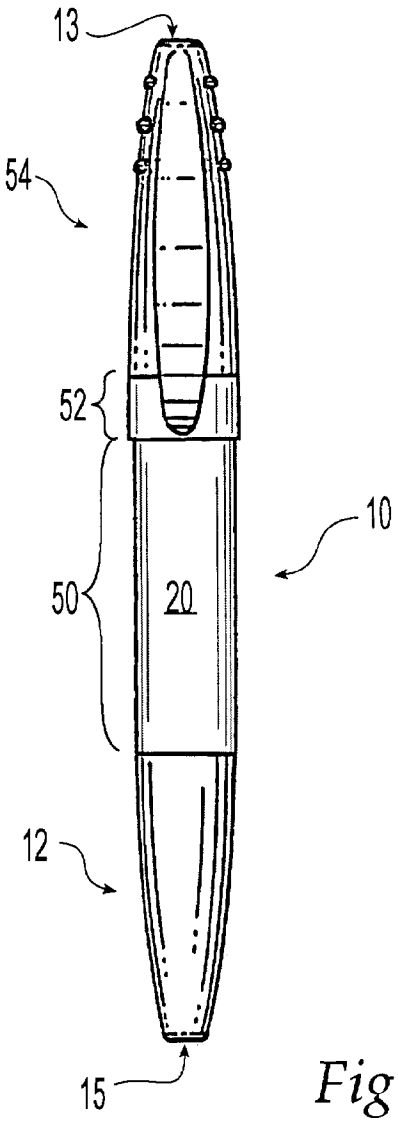
FIG. 5 is a front elevational view of a pocket-type writing instrument with a smooth grip positioned substantially at the midpoint of the writing instrument in accordance with one aspect of the present invention.

The present invention further encompasses a gripping element 10 designed for a writing instrument 12 that is gripped in a central region and intended for use in a wand-like fashion, and a writing instrument 12 with a centrally positioned gripping element 10. Typical writing instruments used as such are markers or other writing instruments with nibs. As understood by those in the art, "nibs" are material-based writing points (e.g., not metal), such as porous material (e.g., plastics), or felt or synthetic tips points, in contrast with ball points or roller balls. Such nibs are typically relatively wider than other writing tips, and are not used for fine, detailed writing, and may be chiseled to permit marking of wide lines. It will be appreciated that the writing instrument with a centrally positioned gripping element need not have a gripping element as described above. Instead, any suitable gripping element imparting the desired grip enhancing characteristics (for example, but without limitation, improved comfort or control during gripping) to writing instrument may be used. For instance, an elastomeric gripping element 10 with a smooth or textured outer surface and without elevated sections may be provided over central region 40 of writing instrument 12 as illustrated in FIGS. 5 and 6. Writing instrument 12 has an elongated writing instrument body with a first end 13, and a second end 15. As may be appreciated from FIGS. 6 and 7, the outer diameter of the barrel of writing instrument 12 may be applied to a pocket type writing instrument as in FIG. 5 (with an average diameter of approximately 16.2 mm) or a tank type writing instrument as in FIG. 6 (with a wider diameter of approximately 21.3 mm). Gripping element 10 may be positioned substantially over central region 40 of writing instrument 12. As used herein, the term "central region" refers to a position that is approximately equidistant from each end of an article. It is noted that reference herein is made to a "central region" for the sake of convenience, and not with any intent to limit a writing instrument to having a gripping element exclusively located in a central region 40 (i.e., in certain embodiments the gripping element may extend from a central region toward a writing tip). However, it will be appreciated that gripping element 10 has distinct ends and an overall length shorter than the writing instrument on which it is positioned. Accordingly, the overall longitudinal extent of gripping element 10 may vary according to the length of the writing instrument body on which gripping element 10 is to be provided, but is limited with respect to the length of the writing instrument body. The present invention is not intended to cover writing instruments completely covered by gripping material. Thus, a gripping element 10 may be arranged along a midpoint 45 equidistant from first end 13 and second end 15. Gripping element 10 is typically positioned and extends at least over midpoint 45 and between midpoint 45 and second end 15.

When gripping element 10 is positioned at a central position on a writing instrument that is used in a wand-like fashion, gripping element 10 enhances gripping during use of writing instrument 12 in such manner. Particularly, a writing instrument 12 of the invention can be grasped in central region 40 and used on a vertical or inverse horizontal (i.e., upside down) surface, wherein such uses typically entail gripping of writing instrument 12 further from the writing end than during conventional writing on a horizontal plane and thus at a substantially central region 40.

Gripping element 10 has a substantially cylindrical portion 50 extending over central region 40. In addition, gripping element 10 may include a band 52 of a wider diameter than cylindrical portion 50 (adjacent first end 13 when positioned on a writing instrument 12). Preferably, the outer diameter of band 52 abuts and has the same outer diameter as the outer diameter of a cap 54 that may cover first end 42 so that a substantially uniform diameter is achieved when cap 54 covers first end 42.

Figure 7:
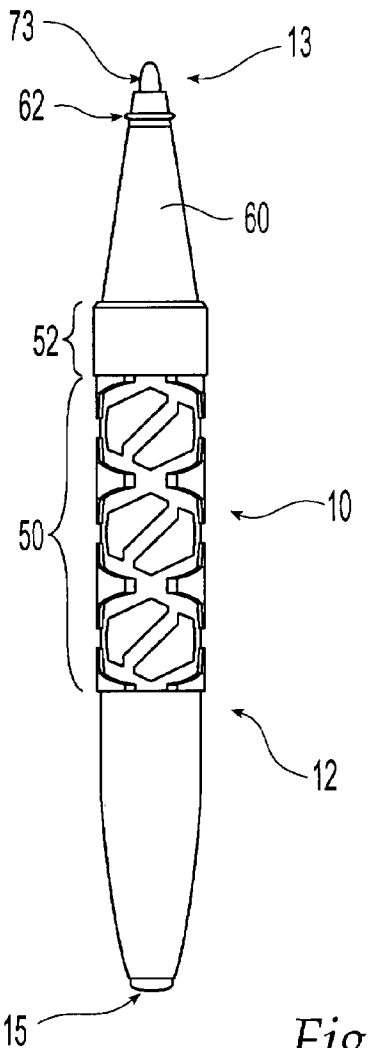
FIG. 7 is an elevational view of a gripping element mounted on a writing instrument, wherein the gripping element extends down the front nose-cone of the writing instrument toward the writing tip.

In one embodiment of the invention, shown in FIG. 7, gripping element 10 includes a front conical gripping portion 60 covering front nose cone 62 of writing instrument 12. Thus, a portion of gripping element 10 may extend over front nose cone 62 toward the writing tip or nib 73 to enhance gripping even when writing instrument 12 is used for fine writing. Front conical gripping portion 60 of gripping element 10 may be formed as a single piece with substantially cylindrical portion 50 of gripping element 10. However, if desired, front conical gripping portion 60 may be of the same or similar material as gripping element 10, but comprised of a separately formed piece positioned preferably adjacent gripping element 10. If a front conical gripping portion 60 is provided, band 52 may be formed as a part of front conical gripping portion 60, separate from substantially cylindrical portion 50 (see, e.g., FIG. 6). Front nose cone 55 may optionally be covered by cap 54 wherein the writing end of writing instrument 12, as well as front conical gripping portion 40 are configured and dimensioned to receive cap 54.

Figure 8:
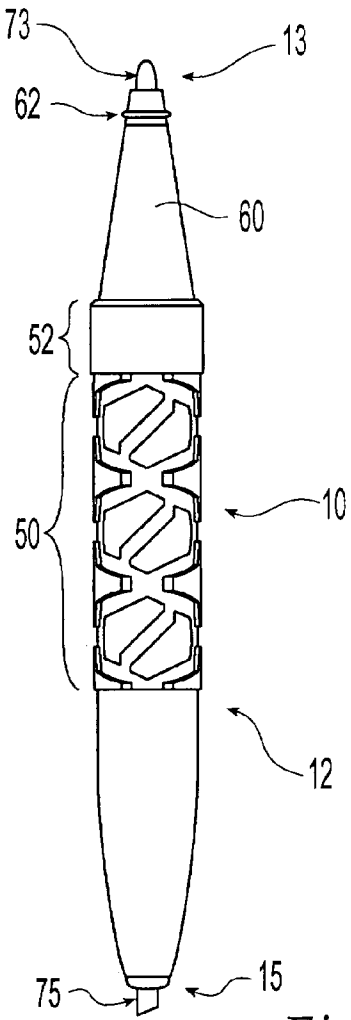
FIG. 8 is an elevational view of a writing instrument with a writing tip at each end and a gripping element at a central portion thereof.

In the embodiment of FIG. 8, writing instrument 12 has a writing tip at both ends. Preferably, writing instrument 12 will have a writing tip 73 at first end 13 and a writing tip 75 and second end 15. Such a writing instrument will have a gripping element 10 configured to be positioned equidistant from ends 40 and 42. It will be appreciated that the central portion of gripping element 10 allows for enhanced gripping during use of either writing tip without requiring the covering of the entire writing instrument body. If two writing types are provided, one may be configured for fine writing (e.g., a ballpoint or roller ball or fine felt or synthetic nib) and the other writing tip may be configured for writing while holding the writing instrument like a wand, as described above.

Writing instrument 12 is well suited for use in an industrial setting because the gripping element 10 is fabricated to avoid slippage, to be wear resistant, and to repel dirt or grime. Thus, gripping is enhanced during use. Moreover, when writing instrument 12 is not in use and is laid on a surface, raised patterns 22, 24 will prevent writing instrument 12 from sliding or rolling away from a user.

It will be appreciated that the various features described herein may be used singly or in any combination thereof. Therefore, the present invention is not limited to only the embodiments specifically described herein. While the foregoing description and drawings represent a preferred embodiment of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiment is therefore to be considered in all respects as illustrative and not restrictive, the scope of the invention being indicated by the appended claims, and not limited to the foregoing description.

What is claimed is:

1. A writing instrument comprising:

an elongated writing instrument body having a first end, a second end, and a central region encompassing a midpoint substantially equidistant from said first end and said second end;

a writing nib at said first end;

a gripping section arranged along said central region of said writing body and used for gripping said instrument during select writing uses; and a substantially cylindrical elastomeric gripping element positioned over and encircling said gripping section along said central region of said writing instrument body and extending at least over said midpoint and ending at a position spaced from said second end such that said gripping element is shorter than said writing instrument body, wherein said gripping element comprises:

an outer surface; and a plurality of elevated sections extending from said outer surface, said elevated sections being raised at least 0.1 mm above said outer surface.

2. The writing instrument of claim 1, wherein said elevated sections have intercalated shapes.

3. A writing instrument comprising:

an elongated writing instrument body having a first end, a second end, and a central region encompassing a midpoint substantially equidistant from said first end and said second end;

a writing nib at said first end;

a gripping section arranged along said central region of said writing body and used for gripping said instrument during select writing uses; and a substantially cylindrical elastomeric gripping element positioned over and encircling said gripping section along said central region of said writing instrument body and extending at least over said midpoint and ending at a position spaced from said second end such that said gripping element is shorter than said writing instrument body, wherein said gripping element comprises:

an outer surface; and a plurality of elevated sections extending from said outer surface, said elevated sections being raised at most 3.0 mm above said outer surface.

4. The writing instrument of claim 1, wherein said outer surface of said gripping element is textured.

5. A writing instrument comprising, an elongated writing instrument body having a first end, a second end, and a central region encompassing a midpoint substantially equidistant from said first end and said second end;

a writing nib at said first end;

a gripping section arranged along said central region of said writing body and used for gripping said instrument during select writing uses; and a substantially cylindrical elastomeric gripping element positioned over and encircling said gripping section along said central region of said writing instrument body and extending at least over said midpoint and ending at a position spaced from said second end such that said gripping element is shorter than said writing instrument body, wherein said writing instrument further comprises a front nose cone adjacent and proximal to said nib; and said gripping element extends over said front nose cone of said writing instrument.

6. The writing instrument of claim 5, further comprising a cap, wherein said front nose cone is configured to be selectively covered by said cap.

7. The writing instrument of claim 5, wherein said gripping element has a textured outer surface.

8. The writing instrument of claim 1, wherein said gripping element is formed from an anti-slip material.

9. The writing instrument of claim 1, wherein said gripping element is formed from resilient material.

10. The writing instrument of claim 1, wherein said gripping element is fabricated of a thermoplastic elastomer.

11. The writing instrument of claim 1, wherein said writing instrument is a felt tip marker.

12. The writing instrument of claim 1, wherein a writing tip is provided at each of said first end and said second end.

* * * * *